US008649706B2

(12) United States Patent
Ino et al.

(10) Patent No.: US 8,649,706 B2
(45) Date of Patent: Feb. 11, 2014

(54) CHARGING APPARATUS AND IMAGE FORMING APPARATUS INCLUDING SAME

(75) Inventors: Toshiaki Ino, Osaka (JP); Hiroo Naoi, Osaka (JP); Katsuya Takano, Osaka (JP); Yasuhiro Nishimura, Osaka (JP); Masaki Ueji, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 133 days.

(21) Appl. No.: 13/188,199

(22) Filed: Jul. 21, 2011

(65) Prior Publication Data

US 2012/0020702 A1 Jan. 26, 2012

(30) Foreign Application Priority Data

Jul. 22, 2010 (JP) ..... 2010-165180

(51) Int. Cl.
*G03G 15/02* (2006.01)
*H01T 19/04* (2006.01)

(52) U.S. Cl.
USPC ..... 399/172; 250/325; 399/173

(58) Field of Classification Search
USPC ..... 399/100, 170, 172, 173, 98; 250/324–326; 361/229
See application file for complete search history.

(56) References Cited

U.S. PATENT DOCUMENTS

| | | | | | |
|---|---|---|---|---|---|
| 4,197,568 | A * | 4/1980 | Inowa et al. | ..... | 361/230 |
| 4,423,134 | A * | 12/1983 | Miyakawa et al. | ..... | 430/103 |
| 4,646,196 | A | 2/1987 | Reale et al. | | |
| 5,485,253 | A * | 1/1996 | Osbourne | ..... | 399/170 |
| 5,568,230 | A * | 10/1996 | Reddy et al. | ..... | 399/100 |
| 6,060,708 | A * | 5/2000 | Grubner | ..... | 250/324 |
| 7,885,572 | B2 * | 2/2011 | Nishio et al. | ..... | 399/98 |
| 2011/0188892 | A1 * | 8/2011 | Ogasawara et al. | ..... | 399/171 |

FOREIGN PATENT DOCUMENTS

| | | | |
|---|---|---|---|
| JP | 62-7065 | | 1/1987 |
| JP | 2-259673 | A | 10/1990 |
| JP | 05-11575 | | 1/1993 |
| JP | 09146341 | A * | 6/1997 |

* cited by examiner

*Primary Examiner* — Robert Beatty
(74) *Attorney, Agent, or Firm* — Nixon & Vanderhye P.C.

(57) ABSTRACT

Disclosed is a corona charging apparatus for electrically charging a surface of an image bearing member to which the corona charging apparatus faces and which is rotatably provided in an electrophotographic image forming apparatus, the corona charging apparatus including: a discharging electrode; a shield case that covers the discharging electrode, the shield case being opened at least in a region where the discharging electrode and the image bearing member face each other; and a sheet-like member being made from aluminum and being attached to a first surface of the shield case which first surface faces the discharging electrode.

6 Claims, 11 Drawing Sheets

| | 2 by 2 Image | Solid Image | Level Average Value |
|---|---|---|---|
| Comparative Example 1 | 3 | 5 | 4 |
| Example 1 | 2 | 3 | 2.5 |
| Example 2 | 2 | 2 | 2 |
| Comparative Example 2 | 1 | 1 | 1 |

| | Detected Amount Of Nitrate Ion (ng/L) | 2 by 2 Image | Solid Image | Level Average Value |
|---|---|---|---|---|
| Comparative Example 1 | 186 | 3 | 5 | 4 |
| Example 2 | 73 | 2 | 2 | 2 |
| Comparative Example 3 | 179 | 2 | 4 | 3 |
| Comparative Example 4 | 73 | 1 | 1 | 1 |

FIG. 14

| | Area Ratio Of Attached Aluminum Sheet | White Spot | Image Deletion |
|---|---|---|---|
| Comparative Example 1 | 0% | × | × |
| Example 1 | 40% | △ | △ |
| Example 2 | 67% | ○ | ○ |
| Example 8 | 85% | ○ | ○ |
| Example 9 | 88% | ◎ | ◎ |
| Example 10 | 90% | ◎ | ◎ |
| Example 11 | 100% | ◎ | ◎ |

CHARGING APPARATUS AND IMAGE FORMING APPARATUS INCLUDING SAME

This Nonprovisional application claims priority under 35 U.S.C. §119(a) on Patent Application No. 2010-165180 filed in Japan on Jul. 22, 2010, the entire contents of which are hereby incorporated by reference.

TECHNICAL FIELD

The present invention relates to a corona charging apparatus and an image forming apparatus including the same.

BACKGROUND ART

In an electrophotographic image forming apparatus, a corona charging method has been conventionally employed as a contact-free charging method. According to the corona charging method, ions are generated by corona discharging, and led to a surface of an image bearing member such as a photoreceptor drum 3 so as to electrically charge it.

Meanwhile, a corona charging apparatus gives rise to a problem that nitrate ions generated by the corona discharge migrate to and adhere to the photoreceptor drum 3 while an image forming operation is stopped, thereby causing an image failure such as white spot to an outputted image.

This problem is described in more detail with reference to FIG. 13. FIG. 13 is an explanation view schematically showing a white-spotted image generation mechanism in the photoreceptor drum 3.

As shown in FIG. 13, ozone ($O_3$) is generated by the corona discharge in the charging apparatus 5. Resultant Ozone ($O_3$) oxidizes nitrogen in the air so as to produce nitrogen oxide ($NO_X$). This nitrogen oxide ($NO_X$) is reacted with moisture in the air so as to be changed to nitric acid ($HNO_3$). Nitric acid produced as such adheres to the surface of the photoreceptor drum 3 near the charging apparatus 5 while the image forming apparatus is left after the image forming operation. Nitrate ions change a surface resistance of an adhered part of photoreceptor drum 3. As a result, a charge retention capability of the photoreceptor drum 3 is decreased at this part. When the image formation is later carried, a white-spotted image is caused due to the decreased charge retention capability.

In order to solve such a problem, a conventional corona discharging apparatus includes a fan for discharging an air from an inside of the corona discharging apparatus. This configuration decreases an amount of $NO_X$ remaining in the corona discharging apparatus after the image forming operation. The configuration thereby decreases an amount of nitric acid that adheres to the photoreceptor drum 3 when the image forming apparatus is left after the image forming operation.

Patent literature 1 discloses a technique in which aluminum hydroxide is applied to an inner surface of a shield case which inner surface faces a discharging electrode, so as to form an aluminum hydroxide coating having no hole and substantially unbroken. The aluminum hydroxide of the coating causes an irreversible neutralization of $NO_X$.

CITATION LIST

Patent Literature 1

Japanese Patent Application Publication, Tokukaisho, No. 62-7065 A (Publication Date: Jan. 14, 1987)

SUMMARY OF INVENTION

Technical Problem

However, the configuration including the fan for discharging the air from the inside of the charging apparatus has the following drawback. Generally, the fan is stopped after a predetermined period of time has passed since the image forming apparatus was stopped. Therefore, there is a limitation on an effect of decreasing nitric acid remaining in the charging apparatus. In order to improve the effect, it may be optional to keep driving the fan after the image forming apparatus has been stopped. In this case, however, electric power consumption is increased.

The technique of Patent Literature 1 has a limitation that, because aluminum hydroxide will be consumed by the irreversible neutralization reaction, it is impossible to stably prevent an adverse effect by nitric acid over an extended period of time. In the technique of Patent Literature 1, it is therefore necessary to change the charging apparatus, each time when aluminum hydroxide is consumed by chemical reactions and thereby having a decrease in a nitric-acid neutralization ability.

In a case of reusing the used shield case in the technique of Patent Literature 1, it is necessary to re-form an aluminum hydroxide coating having no hole and substantially unbroken. For this, however, it is required that the aluminum hydroxide coating is exfoliated, and removed prior to re-application of aluminum hydroxide. This imposes greatly increased work and cost.

The present invention is made in view of the problem, and an object of the present invention is to stably prevent, for an extended period of time at low cost, an image quality deterioration in the corona charging apparatus from being caused due to nitric acid generated in the corona discharge.

Solution to Problem

In order to attain the object, a corona charging apparatus of the present invention for electrically charging a surface of an image bearing member to which the corona charging apparatus faces and which is rotatably provided in an electrophotographic image forming apparatus, the corona charging apparatus including: a discharging electrode; a shield case that covers the discharging electrode, the shield case being opened at least in a region where the discharging electrode and the image bearing member face each other; and a sheet-like member being made from aluminum and being attached to a first surface of the shield case which first surface faces the discharging electrode.

According to the configuration, the sheet-like member absorbs and accumulates nitric acid generated by an electric discharge, so as to reduce an amount of nitric acid that migrates to the surface of the image bearing member while a electric charging operation is stopped. This can stably prevent, for an extended period of time, a white spot image failure that is caused by adhesion of nitric acid to the surface of the image bearing member. For obtainment of such an effect, it is merely required that the sheet-like member is attached. As such, it is possible to obtain a white spot prevention effect at cost lower than cost required for obtaining the white spot prevention effect in a configuration in which a shield case made from aluminum is employed or a configuration in which aluminum hydroxide is applied to an inner wall surface of a shield case. That is, with the configuration, it is possible to stably prevent, for the extended period of time at low cost, the white spot image failure from being caused due to nitric acid generated in the corona discharge.

The corona charging apparatus of the present invention may be configured so that the first surface is in a downstream of the discharging electrode in a rotation direction of the image bearing member. For example, the shield case may have a quadrangular cylinder shape having four side surfaces with respect to a direction in which the shield case is extended, the four side surfaces being one open surface and three close surfaces, and the shield case may be provided so as to be extended in parallel with the rotation axis direction of the image bearing member and so that the open surface faces the image bearing member; and the first surface may be that of the three close surfaces which is provided in the downstream of the discharging electrode in the rotation direction of the image bearing member, the sheet-like member being attached along the direction in which the shield case is extended, so as to cover a region of the first surface, the region being extended in a predetermined range from an open-surface side of the first surface.

According to the configuration, the sheet-like member is attached to a region where a great amount of nitric acid migrates by a corona wind generated between the discharging electrode and the shield case and a wind generated by the rotation of the image bearing member. As such, it is possible to effectively absorb nitric ions by the sheet-like member. Further, according to the configuration, since it is possible to prevent the white spot image failure by using a small amount of the sheet-like member, it is possible to minimizes a cost increase caused by the attachment of the sheet-like member.

Furthermore, a ratio of an area of the sheet-like member to an area of the first surface of the shield case may be not less than 88% but not more than 100%.

With the configuration, it is possible to appropriately prevent a white spot image failure and an image deletion (character blurring or the like) image result.

Furthermore, the sheet-like member may have a film thickness of not less than 30 mm but not more than 80 mm. The sheet-like member whose film thickness falls in this range can appropriately absorb nitric acid.

Furthermore, the sheet-like member may be detachably attached to the shield case.

The configuration brings about an effect that, in a case where the sheet-like member has absorbed a great amount of nitric acid so that its absorptive performance is decreased, for example, it is possible to easily change the sheet-like member by removing the sheet-like member and attaching a new sheet-like member.

An image forming apparatus of the present invention includes any of the charging apparatus described above.

This configuration can stably prevent, for an extended period of time at low cost, a white spot image failure that is caused due to nitric acid generated in the corona discharge.

Advantageous Effects of Invention

As early described, an charging apparatus of the present invention includes a discharging electrode and a shield case that covers the discharging electrode, the shield case being opened at least in a region where the discharging electrode and the image bearing member face each other; and a sheet-like member made from aluminum and being attached to a first surface of the shield case which first surface faces the discharging electrode.

With the configuration, it is possible to stably prevent, for an extended period of time at low cost, a white spot image failure that is caused by nitric acid generated by corona discharge.

BRIEF DESCRIPTION OF DRAWINGS

FIG. 14 is a table showing results of the experiment conducted by using the charging apparatus shown in FIG. 1.

DESCRIPTION OF EMBODIMENTS

One embodiment of the present invention is described.

(1-1. Configuration of Image Forming Apparatus 100)

Figure 2:
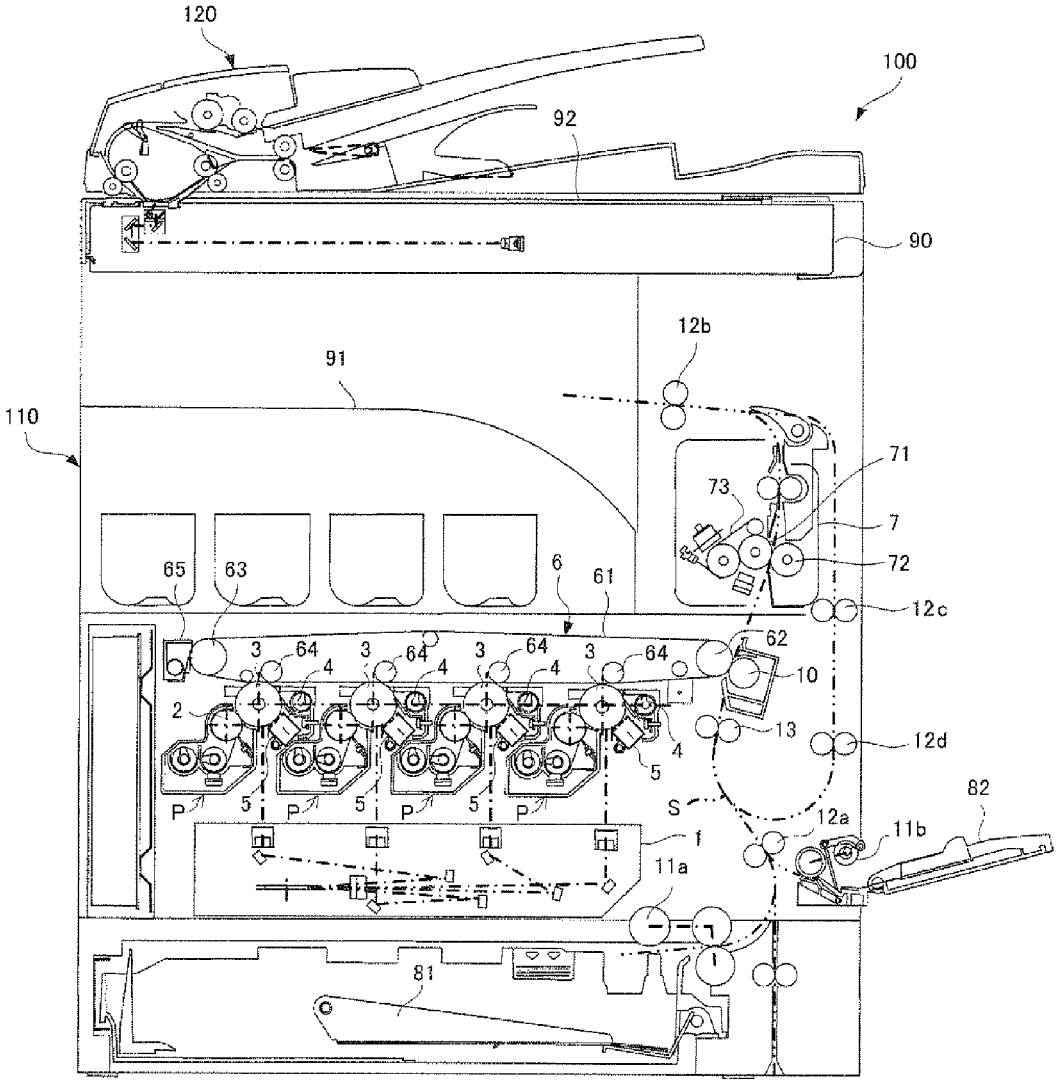
FIG. 2 is a cross sectional view showing an image forming apparatus that includes the charging apparatus shown in FIG. 1.

FIG. 2 is a cross sectional view schematically showing a configuration of an image forming apparatus 100 in accordance with the present embodiment. The image forming apparatus 100 is an electrophotographic image forming apparatus that forms a multi-colored or single-colored image on a recording material (recording sheet), based on image data received from an outer source or image data obtained by scanning a document. The image forming apparatus 100 includes an apparatus main body 110 and an automatic document carrying apparatus 120.

The apparatus main body 110 includes (i) an exposure unit 1, (ii) four image forming sections P, (iii) an intermediate transfer unit 6 including an intermediate transfer belt 61, (iv) a fixing unit 7, (v) an inner paper feeding unit 81, (vi) a manual paper feeding unit 82, and (vii) a paper discharging unit 91. A scanner platen 92, which is made from transparent glass and on which a document is placed, is provided on an upper part of the apparatus main body 110. The automatic document carrying apparatus 120 is attached above the scanner platen 92. The automatic document carrying apparatus 120 automatically feeds a document to the scanner platen 92.

The automatic document carrying apparatus 120 is provided so as to be openable and closable, with respect to the scanner platen 92, on an axis extended in a direction vertical to a sheet on which FIG. 2 is illustrated. The automatic document carrying apparatus 120 is opened so as to allow a user to directly place a document on the scanner platen 92.

In the image forming apparatus 100, the four image forming sections P carry out image formations, based on respective pieces of image data corresponding to different color phases of black (K), cyan (C), magenta (M), and yellow (Y). The four image forming sections P are provided so as to be aligned along a direction (rotation direction) in which the intermediate transfer belt 61 runs. The four image forming sections P have similar configurations.

Figure 3:
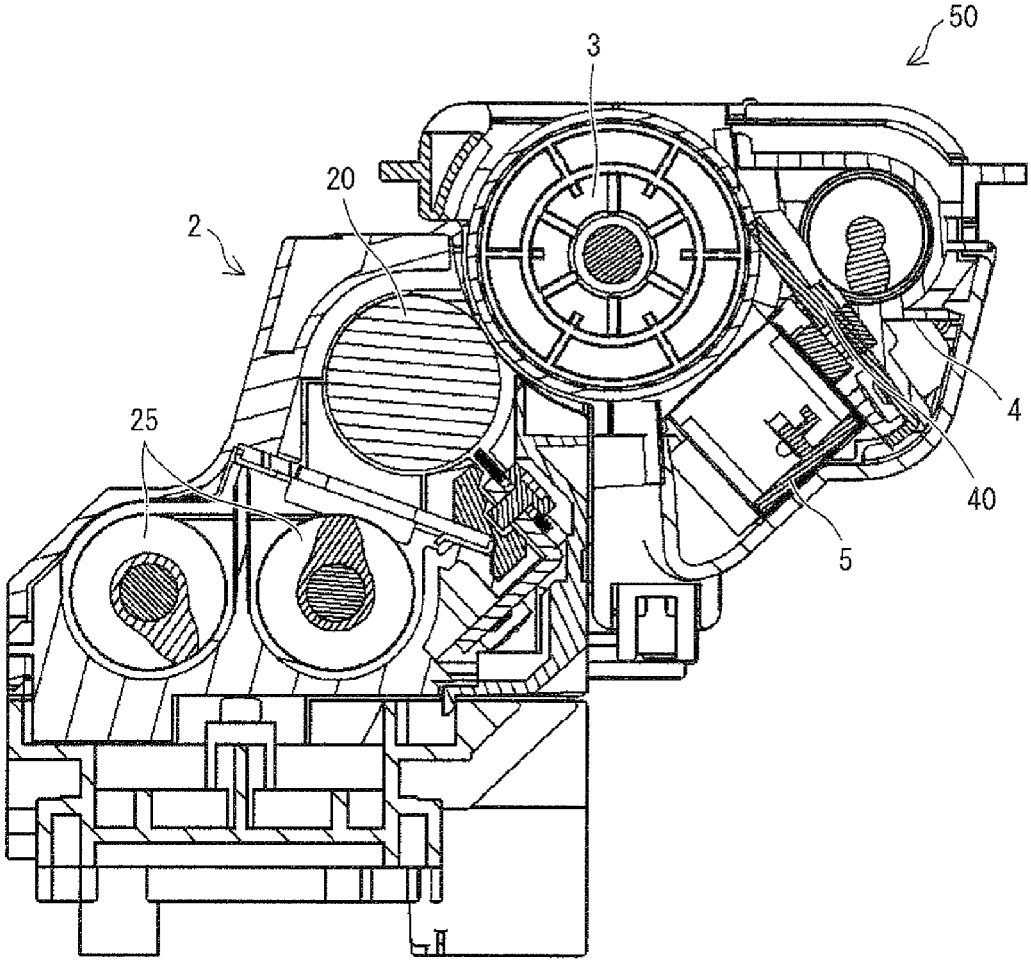
FIG. 3 is a cross sectional view showing an image forming section included in the image forming apparatus shown in FIG. 2.

FIG. 3 is a cross sectional view showing a process cartridge 50 forming each image forming section P. As shown in FIG. 2, the process cartridge 50 includes a developing apparatus 2, a charging apparatus 5, a photoreceptor drum (image bearing member) 3, and a cleaner unit 4.

The photoreceptor drum (image bearing member) 3 has a cylindrical drum shape. The photoreceptor drum 3 is provided so as to be rotatable, by driving means (which is not illustrated), on a rotation axis extended in a direction in which the photoreceptor drums 3 is extended. The photoreceptor drum 3 has an electrically conductive base having a cylindrical shape and a photosensitive layer provided on a surface of the electrically conductive base.

The charging apparatus 5, the developing apparatus 2, and the cleaner unit 4 are provided near the photoreceptor drum 3, so as to be aligned in this order along a rotation direction of the photoreceptor drum 3. The developing apparatus 2 of the each image forming section P contains a yellow (Y), magenta (M), cyan (C), or black (K) toner (developer).

The charging apparatus 5 is a corona charging apparatus. The charging apparatus 5 is provided near the photoreceptor drum 3 so as to be extended along a direction extended in parallel with a rotation axis direction of the photoreceptor drum 3. The charging apparatus 5 uniformly charges a surface of the photoreceptor drum 3 with a given electric potential. The charging apparatus 5 is later described in detail.

The exposure unit 1 is a laser scanning unit (LSU) including (i) a laser emitting section for emitting a laser beam modulated based on image data, (ii) a polygon mirror for receiving the laser beam emitted from the laser emitting section and deflecting it into a main scanning direction, (iii) a convergence lens for concentrating the laser beam deflected in the main scanning direction, so as to focus it on a surface of the photoreceptor drum 3, and (iv) reflection mirrors for reflecting the laser beam concentrated by the convergence lens. The laser beam, which corresponds to the image data, is emitted from the laser emitting section. Then, the laser beam emitted from the laser emitting section is received and deflected by the polygon mirror. The laser beam deflected by the polygon mirror is concentrated by the convergence mirror, and reflected by the reflection mirrors so as to be directed to the surface of the photoreceptor drum 3 to which a voltage of the predetermined electric potential and polarity is applied. This forms an electrostatic latent image corresponding to the image data on the surface of the photoreceptor drum 3. The exposure unit 1 may be, instead of the light scanning unit (LSU), a writing apparatus (for example, a writing head) in which light emitting devices such as EL (Electro Luminescence), LED (Light Emitting Diode), or the like are arranged in array.

The developing apparatus 2 feeds the toner (developer) to the electrostatic latent image formed on the surface of the photoreceptor drum 3, so as to make it visible. The developing apparatus 2 is provided so as to face the photoreceptor drum 3. The developing apparatus 2 includes (i) a developing roller (developer bearing member) 20 for supplying the toner to the electrostatic latent image formed on the surface of the photoreceptor drum 3 and (ii) toner carrying members 25 for carrying the toner stored inside the developing apparatus 2. Further, a doctor blade 23 is provided to an outer rim section of the developing roller 20 so as to be located upstream, with respect to a rotation direction of the developing roller 20, to a region where the developing roller 20 and the photoreceptor drum 3 face each other. The doctor blade 23 forms a thin toner layer on the surface of the developing roller 20.

The cleaner unit 4 includes a cleaning blade 40 provided so as to abut, by a tip part, the surface of the photoreceptor drum 3, as shown in FIG. 3. The cleaning blade 40 scrapes off a residual toner adhering to the surface of the photoreceptor drum 3. With the configuration, the cleaner unit 4 removes and collects the residual toner left on the surface of the photoreceptor drum 3 after developing and image transferring.

The intermediate transfer unit 6 is provided above the photoreceptor drums 3. The intermediate transfer unit 6 includes the intermediate transfer belt 61, an intermediate transfer belt driving roller 62, an intermediate transfer belt driven roller 63, first-transfer rollers 64, and an intermediate transfer belt cleaning unit 65.

The intermediate transfer belt 61 is an endless belt member that runs around the intermediate transfer belt driving roller 62 and the intermediate transfer belt driven roller 63 and forms a loop migration pathway. A thickness of the intermediate transfer belt 61 is approximately 100 μm to 150 μm. The first-transfer rollers 64 are provided so as to face the respective photoreceptor drums 3 via the intermediate transfer belt 61. Regions where the intermediate transfer belt 61 faces the photoreceptor drums 3 are first-transfer regions.

The first-transfer rollers 64 receive first-transfer biases applied by constant voltage controlling, so as to cause toner image transfer from the surfaces of the respective photoreceptor drums 3 to a surface of the intermediate transfer belt 61. The first-transfer biases are opposite in polarities to charged toners. In such circumstances, the toner images of different color phases which are formed on the surfaces of the respective photoreceptor drums 3 are sequentially transferred to an outer surface of the intermediate transfer belt 61 so as to overlap each other. This forms a full-color toner image on an outer surface of the intermediate transfer belt 61. However, in a case where image data corresponding to only some of the yellow, magenta, cyan, and black color phases are inputted, an electrostatic image(s) and a toner image(s) are formed by using only corresponding one(s) of the photoreceptor drums 3 of the respective four image forming sections P. For example, in a case where monochrome image data is inputted, an electrostatic image and a toner image are formed by using only that of the photoreceptor drums 3 which corresponds to the black color phase. Consequently, only a black toner image is transferred to the outer surface of the intermediate transfer belt 61.

Each of the first-transfer rollers 64 is made by coating a metal (for example, stainless) axis having a diameter of 8 mm to 10 mm by an electrically conductive elastic material (for example, EPDM: ethylene-propylene copolymer rubber, urethane foam). The electrically conductive elastic material allows a high voltage to be uniformly applied to the intermediate transfer belt 61.

The toner images, which have been transferred to the outer surface of the intermediate transfer belt 61 by the first-transfer rollers 64, are moved by rotation of the intermediate transfer belt 61 so as to be delivered to a second-transfer region where the intermediate transfer belt 61 and the second-transfer roller 10 face each other At the time of the image formation, the second-transfer roller 10 is pressed against the outer surface of the intermediate transfer belt 61 by a predetermined nip pressure. Here, an inner surface of the intermediate transfer belt 61 is in contact with a surface of the intermediate transfer belt driving roller 62. When the second-transfer roller 10 and the intermediate transfer belt 61 pass through a recording material fed from the inner paper feeding unit 81 or the manual paper feeding unit 82, a high voltage is applied to the second-transfer roller 10. The high voltage is opposite in polarity to the charged toners. This causes toner image transfer to a surface of the recording material from the outer surface of the intermediate transfer belt 61.

The intermediate transfer belt cleaning unit 65 collects and removes the residual toner(s) that has been transferred from some or all of the photoreceptor drums 3 and adhered to the intermediate transfer belt 61 but failed to be transferred to the recording material and thereby left on intermediate transfer belt 61. This prevents the residual toner from being blended with a toner(s) used in a subsequent round of a process. The intermediate transfer belt cleaning unit 65 includes a cleaning blade that abuts the intermediate transfer belt 61 so as to perform toner removal.

The fixing unit 7 includes a heat roller 71 and a pressure roller 72. The recording medium to which the toner image has been transferred is led to the fixing unit 7. When the recording medium is passed through between the heat roller 71 and the pressure roller 72, the toner image on the recording medium is heated and pressurized so as to be firmly fixed on the surface of the recoding material. In the fixing unit 7, the heat roller 71 is provided so as to be in contact with an external fixing belt 73 that externally heats the heat roller 71. Control is performed based on temperature data detected by a temperature detector (which is not illustrated), so that the heat controller 71 is heated to a predetermined fixing temperature. The recording material to which the toner image has been fixed is discharged above the paper discharging unit 91 by the carrying rollers 12*b*.

The image forming apparatus 100 has a paper carrying path S extended in a substantially perpendicular direction, on which paper carrying path S recording materials stored in the inner paper feeding unit 81 and the manual paper feeding unit 81 are passed through (i) between the second-transfer roller 10 and the intermediate transfer belt 61 and) the fixing unit 7 so as to be sent to the paper discharging unit 91. Pick-up rollers 11*a* and 11*b*, a plurality of carrying rollers 12*a* through 12*d*, and registration rollers 13 are provided near the paper carrying path S.

In the image forming apparatus 100, a recording material carried from the inner paper feeding unit 81 or the manual paper feeding unit 82 is sent to the registration rollers 13 by the carrying rollers 12*a* of the paper carrying path S. Then, the recording material is sent to the second-transfer roller 10 at a predetermined timing by the registration rollers 13. When the recording material is passed through between the second-transfer roller 10 and the intermediate transfer belt 61, a toner image is transferred to the recording material. After this, the recording material to which the toner image has been transferred is passed through the fixing unit 7 so that the toner image on the recording material is melted by heating and fixed. Thereafter, the recording material is passed through the carrying rollers 12*b* and discharged above the paper output unit 91.

In the image forming apparatus 100, in a case where a two-side printing mode is selected, images are formed on respective sides of a recording material. Specifically, the recording material to which one-side printing has been carried out is passed through the fixing unit 7 and sent to the carrying rollers 12*b*. When the carrying rollers 12*b* holds a rear end of the recording sheet, it starts rotating in a reversed direction so as to send the recording material to the carrying rollers 12*c* and 12*d*. The recording material sent to the carrying rollers 12*c* and 12*d* is passed through the registration rollers 13, the second-transfer roller 10, and the fixing unit 7 so as to be subjected to back-side printing. After this, the recording material is discharged to the paper output unit 91.

(1-2. Configuration of Charging Apparatus 5)

Figure 1:
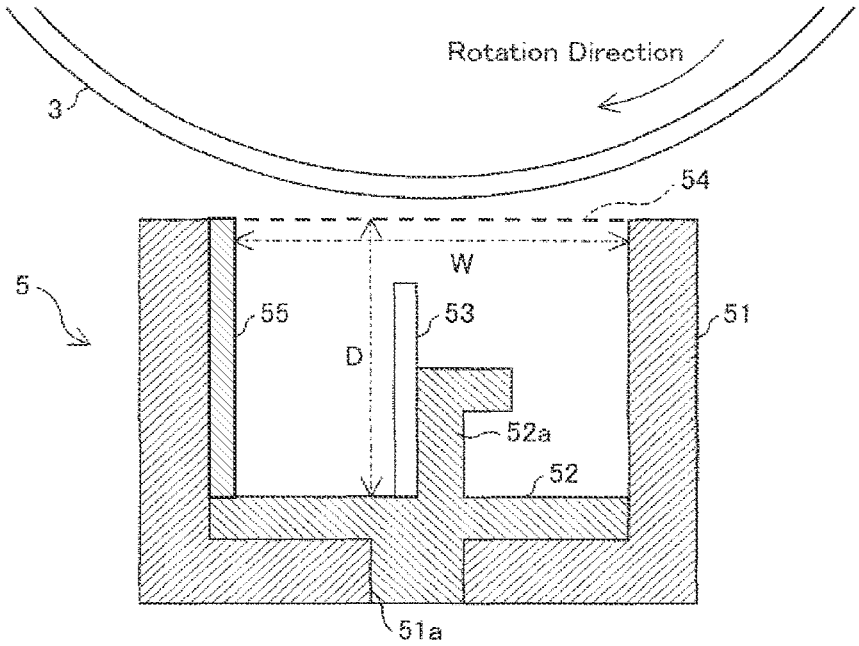
FIG. 1 is a cross sectional view showing a charging apparatus in accordance with one embodiment of the present invention.
Figure 4:
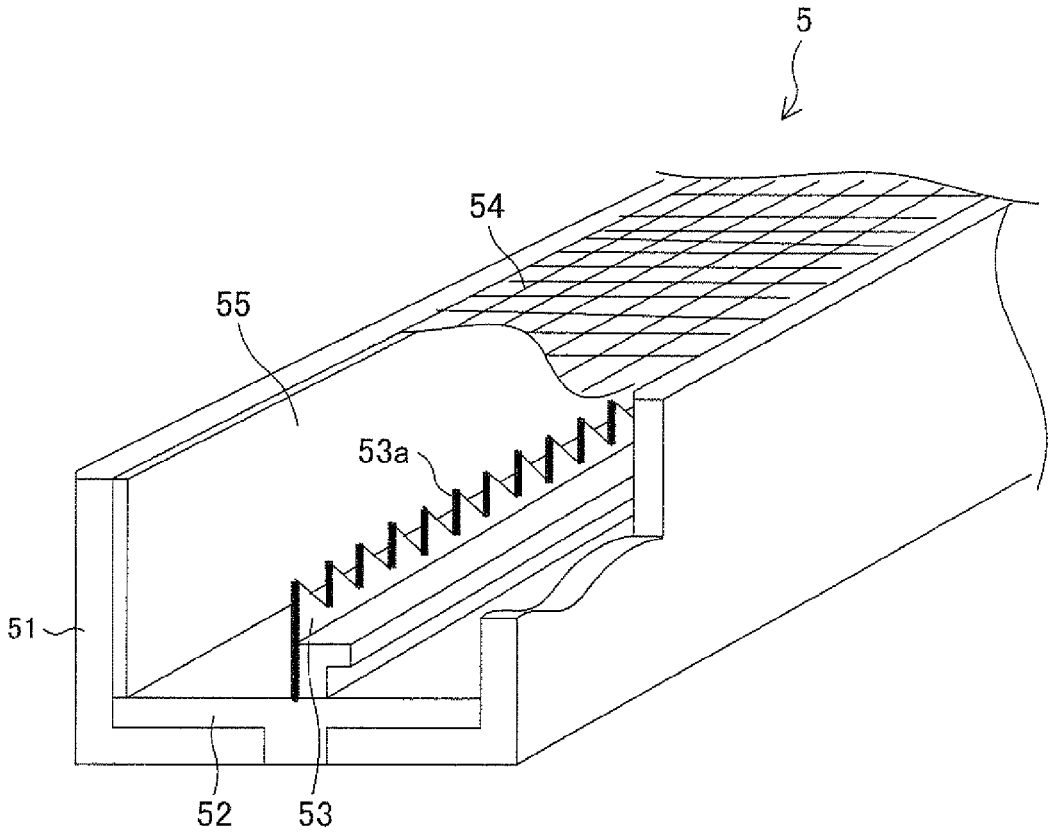
FIG. 4 is a perspective view showing the charging apparatus shown in FIG. 1.
Figure 5:
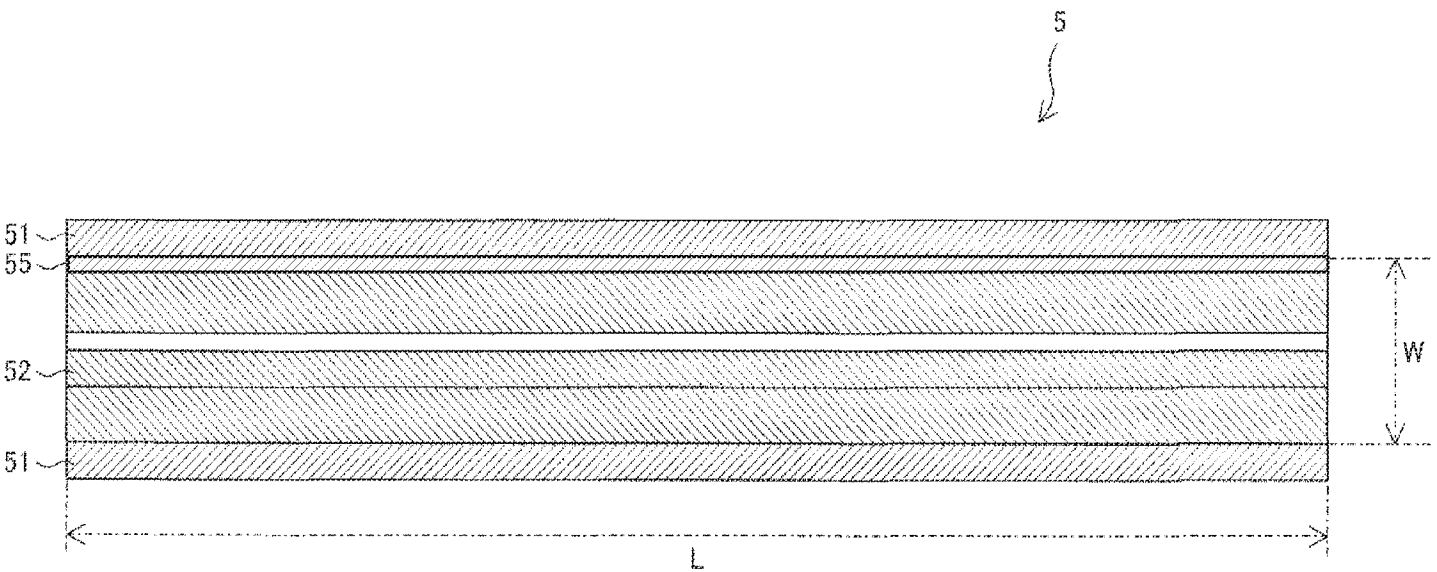
FIG. 5 is a plan view showing the charging apparatus shown in FIG. 1.

FIG. 1 is a cross sectional view schematically showing the charging apparatus 5 shown in FIG. 1 and a surrounding region. FIG. 4 is a perspective view schematically showing a configuration of the charging apparatus 5. FIG. 5 is a plan view showing the charging apparatus 5 (except a grid electrode 54) from the photoreceptor drum 3.

The charging apparatus 5 includes a shield case 51, a discharging electrode holding section 52, a discharging electrode 53, the grid electrode 54, and an aluminum sheet 55.

The shield case (charger case, protective housing) 51 has a quadrangular tube shape from which one side surface is removed. The shield 51 has a cross section having a rectangular cup-like shape opened in one plane and closed in three other planes. That is, the shield case 51 has four side surfaces, the four side surfaces being one open surface and three close surfaces, and houses the discharging electrode 53 in a space surrounded by the three close surfaces. The shield case 51 therefore protects the discharging electrode 53, and ensures that the discharging electrode 53 stably performs corona discharge in a discharge space formed inside the shield case 51.

The shield case 51 is not limited to a particular material, provided that it has an electrically conductive property. In the present embodiment, the shield case 51 is made from stainless. In the present embodiment, a width w, depth D, and length L of the shield case 51 are 13 mm, 14.9 mm, and 322 mm respectively, where (i) the width w is a distance between first and second inner wall surfaces of the shield case 51, the first inner wall surface being in the upstream in the rotation direction of the photoreceptor drum 3 and the second inner wall surface in the downstream of the same, (ii) the depth D is a distance between the grid electrode 54 and an upper surface of the discharging electrode holding member 52, and (iii) the length L is a longitudinal length of the shield case 51 (longitudinal direction is a direction in which the charging apparatus 5 is extended, that is, the direction extended in parallel with the rotation axis direction of the photoreceptor drum 3).

As shown in FIG. 4, the discharging electrode 53 is a saw-tooth-like electrode having pointed protrusion sections (sharp protrusions) 53*a* provided at intervals along a direction in which the discharging electrode 53 is extended. The discharging electrode 53 is fixed and supported at a bottom surface (opposing side surface to the plane in which the grid electrode 54 is provided) of the shield case 51 by the discharging electrode holding member 52 so that the pointed protrusion sections 53*a* are pointed to the photoreceptor drums 3. In the present embodiment, the discharging electrode 53 is prepared by etching a stainless plate of a plate thickness of 0.1 mm, a width of 13 mm, and a length of 328 mm so as to form therein the pointed protrusion sections 53*a* having constant 3 mm pitches and being rounded at tip ends to have curvature radii R of 30 μm. However, the discharging electrode 53 is not limited to this configuration. For example, the pitches of the pointed protrusion sections 53*a* may be set to any values between 2 mm and 5 mm, and the curvature radii R of the pointed protrusion sections 53*a* may be set to any value between 30 μm to 40 μm. Further, the discharging electrode 53 may be made from a material other than stainless. Furthermore, the discharging electrode 53 is not limited to the saw-tooth-like shaped electrode, but may be a plurality of linear or needle-like electrodes pointed to the photoreceptor drum 3, a brush electrode in which tip parts of protrusions are pointed to the photoreceptor drum 3, or a wire-like electrode provided so as to be extended in a direction parallel with the axis direction of the photoreceptor drum 3.

The discharging electrode holding member (supporting member) 52 is an insulating member. The discharging electrode holding member 52 is fitted in and fixed to a chipped section (recessive section) 51*a* provided in the bottom surface of the shield case 51. The discharging electrode holding member 52 fixed as such supports the discharging electrode 53 and electrically isolates the discharging electrode 53 and the shield case 51 from each other. The discharging electrode holding member 52 can be made from a material such as an ABS resin, an acrylic resin, or the like, for example.

Specifically, the discharging electrode holding member 52 has a protrusion section 52*a* that (i) protrudes from the bottom surface of the shield case 51 toward an upper plane (the side plane in which the grid electrode 54 is provided) of the shield case 51 and (ii) is extended along the direction in which the shield case 51 is extended. The protrusion section 52*a* has a side surface provided in the downstream of the rotation direction of the photoreceptor drum 3, to which side surface a first side surface of the discharging electrode 53 is attached. Here, a width of a contact part where the protrusion section 52*a* is in contact with the discharging electrode 53 is 13 mm. The protrusion section 52*a* is in contact with an entire part of the discharging electrode 53 with respect to the direction in which the discharging electrode 53 is extended (the direction extended vertically to the sheet on which FIG. 1 is illustrated). A method for attaching the discharging electrode 53 to the discharging electrode holding member 52 is not particularly limited. For example, the discharging electrode 53 may be attached to the discharging electrode holding member 52 by use of an adhesive agent or an attaching member such as a screw, a clip, a pin, or the like, or by fitting or engaging.

The grid electrode 54 is a mesh electrode. The grid electrode 54 is provided on the plane on which the shield case 51 is opened (that plane of the charring apparatus 5 which faces the photoreceptor drum 3), i.e., between the discharging electrode 53 and the photoreceptor drum 3, so as to be electrically isolated from the discharging electrode 53 and the photoreceptor drum 3. In the present embodiment, the grid electrode 54 is prepared by etching a stainless plate of a plate thickness of 0.1 mm so as to obtain a mesh which has a mesh width of 1 mm and is formed by a fine linear member.

The charging apparatus 5 includes (1) grid voltage applying means (which is not illustrated) for applying an electric potential to the grid electrode 54 and the shield case 51, the electric potential being different from an earth electric potential by an electric potential difference Vg (Vg<0), and (ii) discharge voltage applying means (which is not illustrated) for applying an electric potential to the discharging electrode 53, the electric potential being different from the earth electric potential by an electric potential difference Vc (Vc<Vg<0). Applying the electric potential Vg to the grid electrode 54 and the shield case 51 and the electric potential Vc to the discharging electrode 53 generates an electric field between the shield case 51 and the discharging electrode 53. The electric field causes ionization of an atmosphere, thereby generating a negative electric charge (negative ion) around the discharging electrode 53. The negative electric charge migrates toward the photoreceptor drum 3 spreadingly by attraction caused by the grid electrode 54. Some of the negative electric charge is passed through the grid electrode 54 to reach the surface of the photoreceptor drum 3, thereby charging the surface of the photoreceptor drum 3.

An aluminum sheet (sheet-like member) 55 is detachably attached to the second inner wall surface of the shield, case 51 which second inner wall surface is in the downstream of the rotation direction of the photoreceptor drum 3, i.e., the second inner wall surface that faces a second side surface of the discharging electrode 53 which second side surface is an opposite side surface to the first side surface of the discharging electrode 53 which first side surface is attached to the protrusion section 52*a*. The aluminum sheet 55 may be, for example, a conventionally commercially available sheet prepared by stacking an aluminum foil and an adhesive agent. A thickness of the aluminum foil is not particularly limited. For example, the thickness of the aluminum foil may be approximately 30 μm to 100 μm. The adhesive agent via which the aluminum sheet 55 is attached to the shield case 51 may be an electrically conductive adhesive agent such as an acrylic-based electrically conductive adhesive agent or the like, for example.

In the present embodiment, the aluminum sheet 55 absorbs and accumulates a pollutant gas component containing nitrate ions or the like. This prevents the pollutant gas from migrating to and adhering to the surface of the photoreceptor drum 3*a* and thereby causing a deterioration in image quality (white spot or the like).

Figure 6:
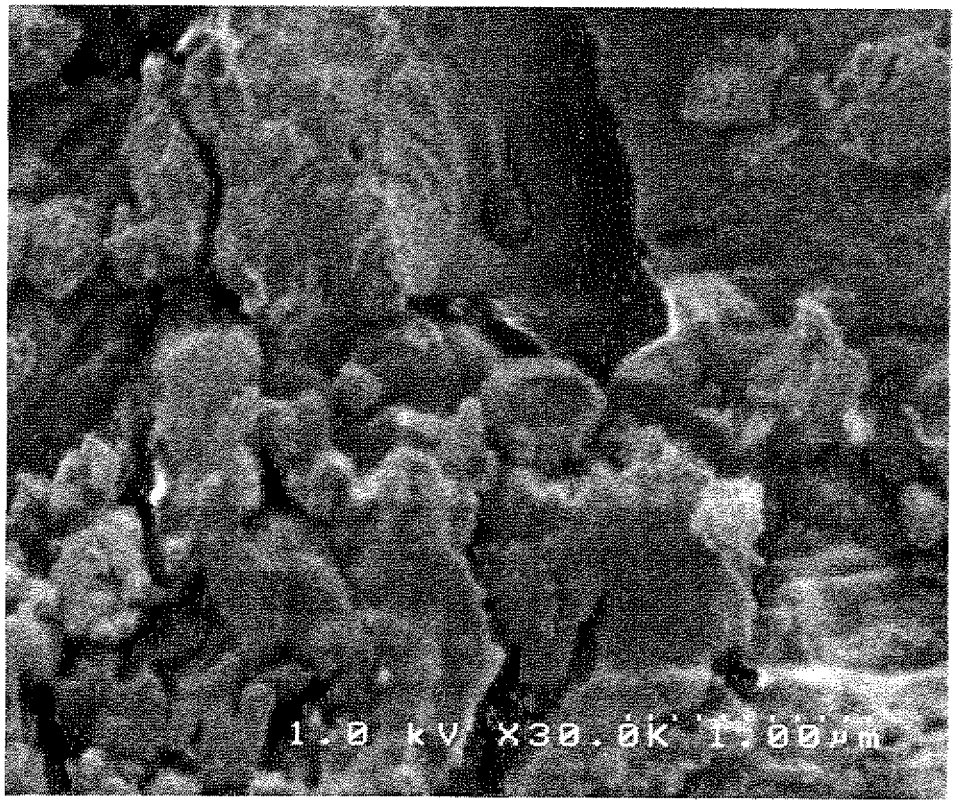
FIG. 6 is an enlarged view showing a surface of an aluminum sheet included in the charging apparatus shown in FIG. 1.

Specifically, the aluminum sheet 55 attached to the inner wall surface of the shield case 51 is oxidized by an ozone gas generated by corona discharge or the like, so as to form aluminum oxide. FIG. 6 shows an image of the surface of the aluminum sheet 55 captured by using an SEM (Scanning Electron Microscope), the aluminum sheet 55 being removed from the charging apparatus 5 that has been installed in the image forming apparatus 100 and used in an image forming operation. As shown in FIG. 6, a surface of aluminum oxide has a plurality of holes (surface roughness of aluminum oxide is rough). As such, aluminum oxide absorbs and accumulates the pollutant gas component that contains $NO_X$ (NO, $NO_2$) generated by the corona discharge and nitrate ions ($HNO_3$) generated by an reaction to surrounding moisture, or the like. Such absorption and accumulation of the pollutant gas component can decrease an amount of the pollutant gas that migrates to the surface of the photoreceptor drum 3 from the charging apparatus 5 in a case where the image forming apparatus 100 is left for an extended period of time after the image forming operations have been stopped. This can prevent a sensitivity of the photoreceptor drum 3 from being lowered by adherence of the pollutant gas to the surface of the photoreceptor drum 3. It is therefore possible to prevent an image failure such as a white spot or the like.

The first side surface of the discharging electrode 53, which first side surface is in the upstream of the rotation direction of the photoreceptor drum 3, is attached to the protrusion section 52*a* of the discharging electrode holding member 52. In such circumstance, a corona wind is generated by the corona discharge in a direction coming from the discharging electrode 53 toward that second inner wall surface of the shield case 51. Further, the rotation of the photoreceptor drum 3 generates a wind flowing from the upstream to downstream of the rotation direction of the photoreceptor drum 3. By influences of this wind and the corona wind, a greater amount of a discharged product reaches the second inner wall surface of the shield case 51, as compared to an amount of the discharged product reaching the first inner wall surface of the shield case 51 which is in the upstream of the rotation direction of the photoreceptor drum 3. In view of this, in the present embodiment, the aluminum sheet 55 is attached to the second inner wall surface of the shield case 51. It is therefore possible to efficiently absorb the pollutant gas component by a small amount of the aluminum sheet 55. However, a location to which the aluminum sheet 55 is attached is not limited to the second inner wall surface of the shield case 51. For example, the aluminum sheet 55 may be attached to each of the first and second inner wall surfaces of the shield case 51.

(1-3. Experimental Result)

(1-3-1. Experiment 1 (Nitrate Ions Detection Experiment))

The following description discusses results of an experiment in which relationships between sizes of the aluminum sheet 55 and nitrate ions decrease effects were studied.

In Experiment 1, image forming processes were actually carried out by using different charging apparatuses 5 (i) through (iv), and then, measurements were carried out so as to measure amounts of nitric acid left in spaces within the respective charging apparatuses (i) through (iv) after the image forming processes, (i) the charging apparatus 5 in which the aluminum sheet 55 was removed (Comparative Example 1), (ii) the charging apparatus in which a width of the aluminum sheet 55 was 6 mm (Example 1), (iii) the charging apparatus in which a width of the aluminum sheet 55 was 10 mm (Example 2), and (iv) the charging apparatus in which a shield case, which was made from aluminum and had a same shape as the shield case 51 made from stainless, was employed instead of the shield case 51 (Comparative Example 2).

In each of Examples 1 and 2, a length of the aluminum sheet 55 was 322 mm so as to be identical with the longitudinal length of the shield case 51 (longitudinal direction was the direction in which the shield case 51 was extended). Further, the aluminum sheet 55 was attached to the second inner wall surface of the shield case 51 which second inner wall surface was in the downstream of the rotation direction of the photoreceptor drum 3, in such a manner that a longitudinal side of the aluminum sheet 55 was aligned to a photoreceptor-drum-3 side of the second inner wall surface of the shield case 51 (that longitudinal side of the inner wall surface of the shield case 51 which faced the photoreceptor drum 3). In each of Examples 1 and 2, the aluminum sheet 55 was a metallic foil sheet manufactured by DIC Corporation (product number of 52050LA, a flexible aluminum film thickness was 50 μm, and an electrically conductive acrylic-based adhesive agent was used).

The charging apparatuses 5 of Examples 1 and 2 and Comparative Examples 1 and 2 were tested in the following conditions. In each of Examples 1 and 2 and Comparative Examples 1 and 2, the charging apparatuses 5 were installed to CMYK image forming sections P of the image forming apparatus 100. Then, the image forming apparatus 100 carried out image forming operations with respect to 100,000 pieces of A-4 size (210 mm×297 mm) recording sheets in a thermally neutral and low humid environment condition that a temperature was 25° C. and a humidity was 5%. In this case, installation rotation was carried out so that the charging apparatuses 5 were re-installed to the different CMYK image forming sections P every 3,000 pieces of A-4 recording sheets. Therefore, the charging apparatuses 5 were installed equally to all of the image forming sections P. After the image forming operations, one of the charging apparatuses 5, for which nitric acid detection would be carried out, was installed to the C (cyan) image forming section P. Then, the image forming apparatus 100 carried out 5% density color printing (image forming) with respect to 500 pieces of recording sheets. Immediately after this, the image forming apparatus 100 was turned off so as to stop fans discharging air from insides of the respective charging apparatuses 5. Then, while the image forming apparatus 100 was kept turned off, a gas was sucked from the inside of the charging apparatus installed in the C (cyan) image forming section P at a suction speed of 0.5 L/min for 30 minutes so that a total of 15 L of the gas was collected in an impinger. Then, an amount of nitrate ions in the collected gas was measured by ion chromatography analysis.

Figure 7:
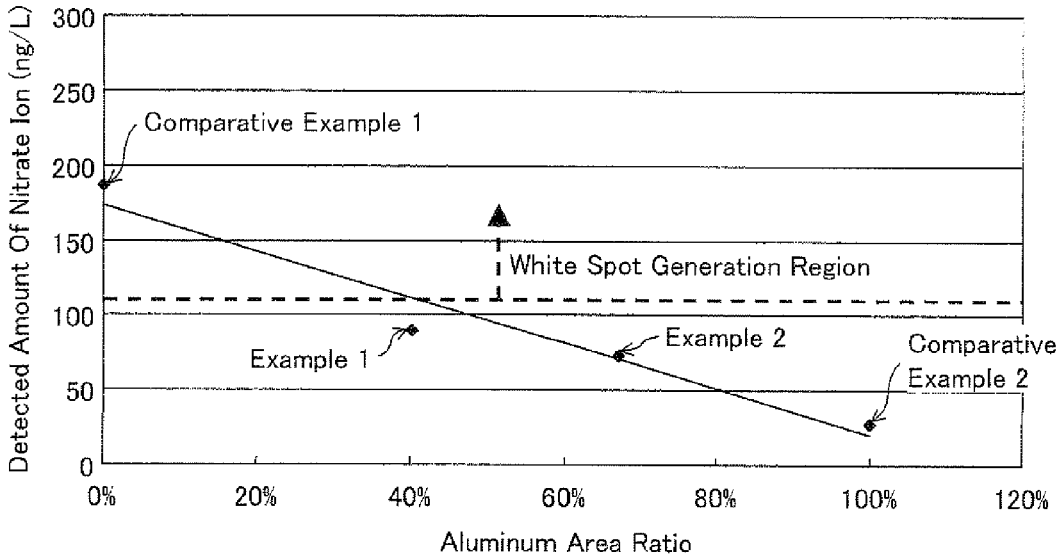
FIG. 7 is a graph showing results of experiment conducted by using the charging apparatus shown in FIG. 1.

FIG. 7 is a graph showing each experiment result. In FIG. 7, the horizontal axis of the graph shows an aluminum area ratio. The aluminum area ratio is a ratio of an area of an aluminum member (in each of Examples 1 and 2, an area of a region to which the aluminum sheet 55 was attached, and in Comparative Example 2, an area of an inner wall surface of the shield case) to an area of that inner wall surface of the shield case 51 which faced the discharging electrode 53 (the second inner wall surface of the shield case 51).

The dashed line in the graph shows a lower limit value (110 ng/L) of an amount of nitric acid, on or above which lower limit value a white spot corresponding to the practically problematic level is caused. The actual line in the graph is a linear line which is a linear approximation of a relationships between the aluminum area ratios and detected amounts of nitrate ions.

As shown in FIG. 7, 186 ng/L of nitrate ions were detected in Comparative Experiment 1 in which no aluminum sheet 55 was attached to the shield ease 51 made from the stainless. On the other hand, amounts of nitrate ions were decreased to 90 ng/L and 73 ng/L in Examples 1 and 2 in each of which the aluminum sheet 55 was attached to the shield case 51. Further, 27 ng/L of nitrate ions were detected in Comparative Example 2 in which the shield case 51 made from aluminum was used.

In the experiment, it was demonstrated that in a case of providing the aluminum member to the inner wall surface of the shield case 51, it was possible to reduce the amount of nitrate ions remained in the space inside the charging apparatus 5 left after the image forming operation.

Here, in a case of employing the shield case 51 made from aluminum sheet, it was possible to obtain a greatest nitrate ions reduction effect. It was demonstrated that, in a case of attaching the aluminum sheet 55 to that inner wall surface of the shield case 51 which faced the discharging electrode 53, it was possible to decrease residual nitrate ions to such an amount that caused no white spot.

Further, it was demonstrated that the nitrate ions reduction effects obtained by attaching the aluminum sheet 55 were varied substantially proportionally to changes in the aluminum area ratio, that is, the detected amounts of nitrate ions were decreased at a decrease rate increased proportionally to the increase of the aluminum area ratio.

Figure 8:
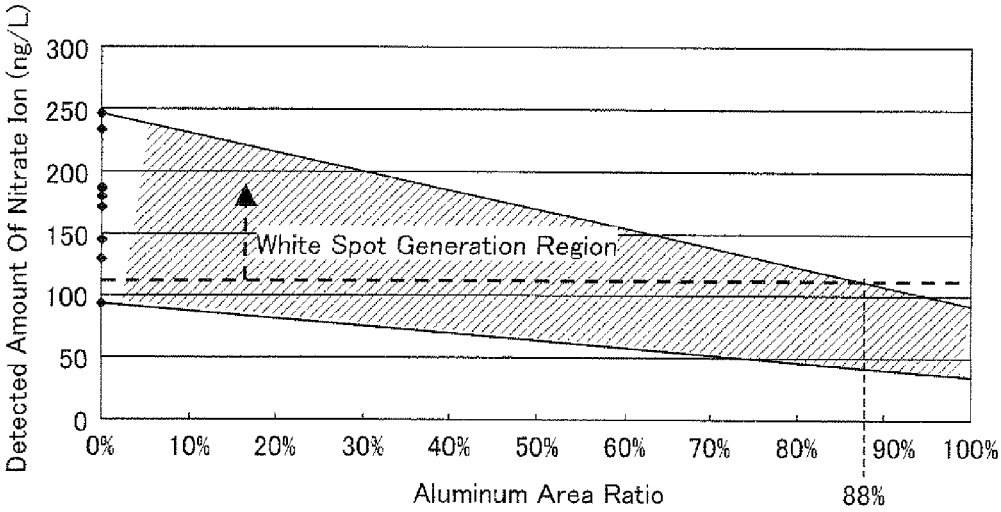
FIG. 8 is a graph showing a result of an experiment conducted by using the charging apparatus shown in FIG. 1.
Figure 9:
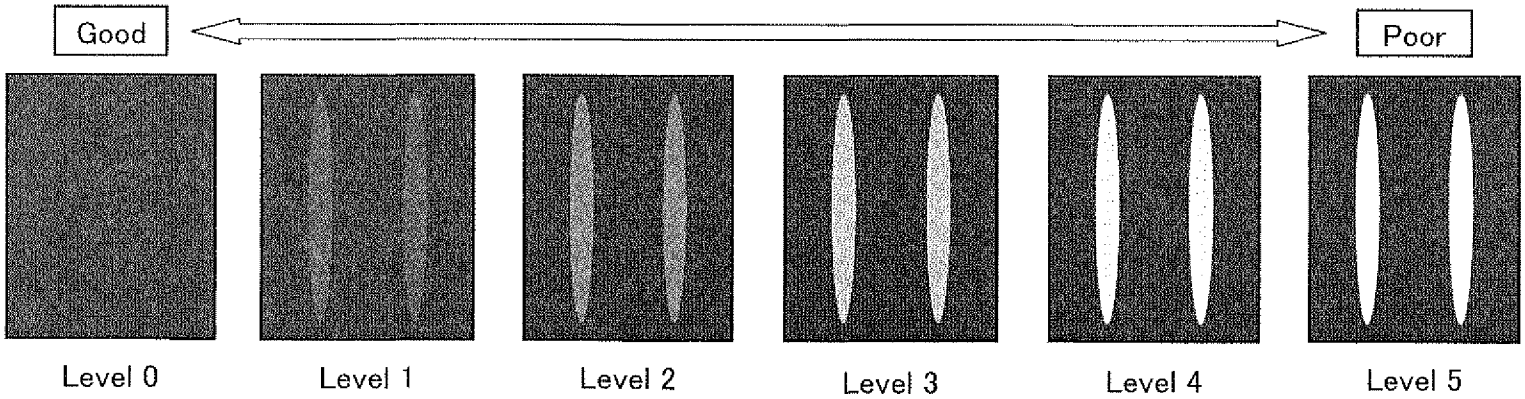
FIG. 9 is an explanation view showing a white spot evaluation index employed in the experiment conducted by using the charging apparatus shown in FIG. 1.

FIG. 8 are graphs showing (i) amounts of nitrate ions (points plotted with respect to an aluminum area ratio of 0%) that were detected by the same detecting method as above in cases where the image forming apparatuses 100, in which the charging apparatuses 5 including no aluminum sheet 55 were employed, were driven in different conditions, and (ii) a result of calculation that calculated, based on the decrease rate obtained from the experiment results shown in FIG. 7 (the decrease rate of the amount of nitrate ions with respect to the increase of the aluminum area ratio), amounts of nitrate ions that were detected in a case where the aluminum sheet 55 was attached.

Here, the amount of nitrate ions remaining in the space inside the charging apparatus 5 after the image forming operation was varied depending on an operation environment. In a case where the image forming operation was carried out in the severest operation environment by employing no aluminum sheet 55, the amount of nitrate ions was approximately 246 ng/L (see FIG. 8). If the amount of nitrate ions was 110 ng/L or greater, there was caused a white spot corresponding to the practically problematic level. However, by setting the aluminum area ratio to 88% or greater (setting the width of the aluminum sheet 55 to 13.1 mm or greater), it was possible to prevent the white spot irrespective of the operation condition (see FIG. 8).

(1-3-2. Experiment 2 (White Spot Detection Experiment))

The following description discusses results of an experiment in which relationships between sizes of the aluminum sheet 55 and white-spot reduction effects were studied.

In Experiment 2, the charging apparatuses of Comparative Examples 1 and 2 and Examples 1 and 2 were tested in the following conditions. In each of Comparative Examples 1 and 2 and Examples 1 and 2, the charging apparatuses 5 were installed to the respective CMYK image forming section P of the image forming apparatus 100. By using the image forming apparatus 100 having this configuration, image forming operations was carried out to 100,000 pieces of A-4 size recording sheets under a room-temperature and low humid environment condition that a temperature was 25° C. and a humidity was 5%. In this case, installation rotation was carried out so that the charging apparatuses 5 were re-installed to the different CMYK image forming sections P every 3,000 pieces of the A-4 size recording sheets. After the image forming operations, one of the charging apparatuses 5, for which nitrate ions detection was carried out, was installed to the C (cyan) image forming section P. With this configuration, 5% density color printing (image forming) was carried out with respect to 500 pieces of sheets. Immediately after this, the image forming apparatus 100 was turned off so as to stop the fans discharging air from insides of the respective charging apparatuses 5, and was then left for 30 minutes. Then, the image forming apparatus 100 formed 2 by 2 halftone images and 2 by 2 halftone solid images (whose density value was 64) on recording sheets (the 2 by 2 halftone images and the 2 by 2 halftone solid images were images consisting of 16 dots (4 dots in a main scanning direction by 4 dots in a sub scanning direction), the images being divided into 4 grids each consisting of 4 dots (2 dots in the main scanning direction by 2 dots in the sub scanning direction), for each of which 4 grids it was set whether any image was formed or not). Then, for the 2 by 2 halftone images and the 2 by 2 halftone solid images formed on the recording sheets, white spot evaluation was carried out by visual inspection.

An evaluation method was arranged as follows. Sample images classified to a level 0 through a level 5 were prepared in advance. An evaluation target image on each recording sheet was compared to the sample images so as to be classified to a level corresponding to a closest one of the sample images.

Figures 10, 11, 12:
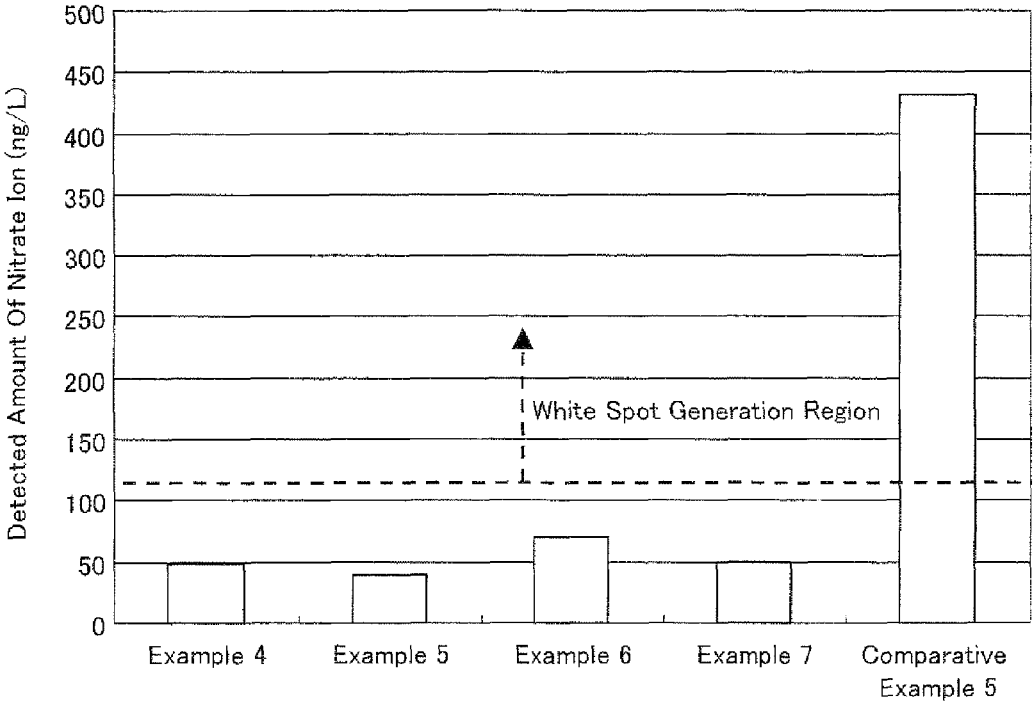
FIG. 10 is a table showing results of the experiment conducted by using the charging apparatus shown in FIG. 1.
FIG. 11 is a table showing results of the experiment conducted by using the charging apparatus shown in FIG. 1.
FIG. 12 is a graph showing results of experiment conducted by using the charging apparatus shown in FIG. 1.
Figure 13:
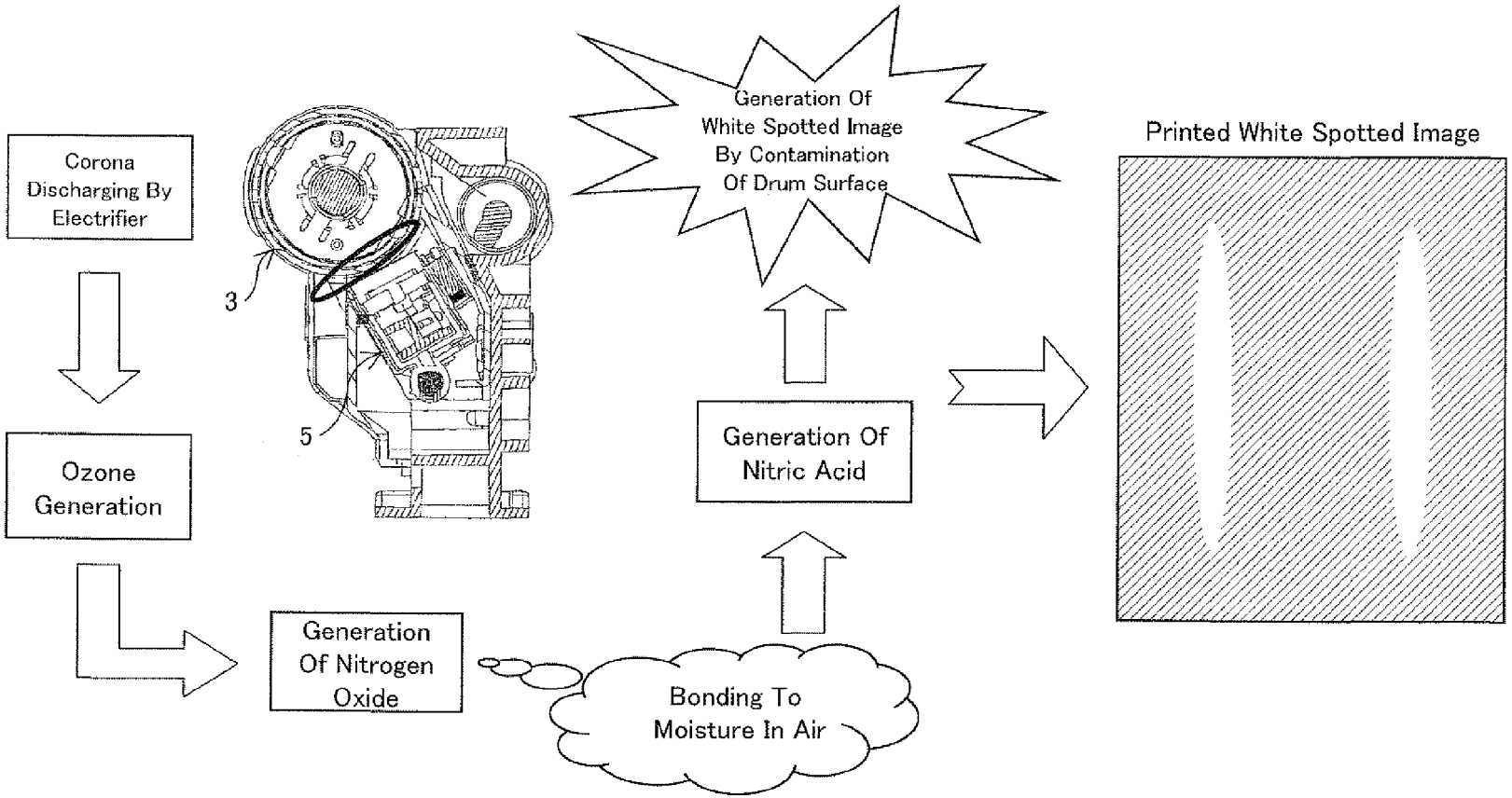
FIG. 13 is an explanation view showing a white spot generation mechanism in the image forming apparatus employing the corona charging apparatus.

FIG. 10 is a table showing evaluation results. As shown in FIG. 10, white spot reduction effects were obtained by attaching the aluminum sheets 55. Further, it was demonstrated that the greater the areas of the aluminum sheets 55 attached were, the greater the white spot reduction effects were.

(1-3-3. Experiment 3 (Experiment for Studying Relationship Between Location where Aluminum Sheet is Attached and White Spot Reduction Effect))

The following description discusses results of an experiment in which it was studied how white spot reduction effects differed between a case in which the aluminum sheet 55 was attached to each of the first and second inner wall surfaces of the shield case 51, the first inner wall surface being in the upstream of the rotation direction of the photoreceptor drum 3 and the second inner wall surface being in the downstream of the same, and a case in which the aluminum sheet 55 was attached only to the second inner wall surface of the shield case 51.

In the experiment, image forming operations were carried out by using charging apparatuses 5 of Comparative Examples 3 and 4 constructed as follows. After the image forming operation, amounts of nitrate ions remaining in spaces inside the charging apparatuses 5 were measured. Further, white spot detection experiment was carried out.

The charging apparatus 5 of Comparative Example 4 had a configuration similar to the configuration of the charging apparatus 5 of Comparative Example 1. That is, no aluminum sheet 55 was attached to the shield case 51 that is made from stainless. The charging apparatus of Comparative Example 5 had a configuration in which, in addition to the configuration of the charging apparatus of Example 2, an aluminum sheet 55 whose width was 10 mm was attached to the first inner wall surface of the shield case 51 which first inner wall surface was in the upstream of the rotation direction of the photoreceptor drum 3.

In Experiments 1 and 2, the charging apparatuses 5 were tested after performing the image forming operations with respect to 100,000 pieces of A-4 size recording sheets under the room-temperature and low humid environment condition that a temperature was 25° C. and a humidity was 5%. In Experiment 3, in contrast, the charging apparatuses 5 of Comparative Examples 3 and 4 were tested after performing the image forming operations with respect to 120,000 pieces of A-4 size recording sheets under the room-temperature and low humid environment condition that a temperature was 25° C. and a humidity was 5%. Other than the above, the charging apparatuses 5 of Comparative Examples 3 and 4 were tested in same conditions as Examples 1 and 2.

FIG. 11 is a table showing nitrate ions detection results and white spot evaluation results of Comparative Example 1, Example 2, Comparative Example 3, and Comparative Example 4.

As shown in FIG. 11, a detected amount of nitrate ions in Example 2 was identical with that in Comparative Example 4, and a value of white spot level evaluation in Example 2 was substantially identical with that in Comparative Example 4. This demonstrated that, in a case of attaching the aluminum sheet 55 to the second inner wall surface of the shield case 51, it was possible to obtain, by using a smaller amount of the aluminum sheet 55, an effect substantially same as the effect obtained in a case of attaching the aluminum sheet 51 to each of the first and second inner wall surfaces of the shield case 51.

As for the white spot, it could be said that a white spot classified to the level 2 or a lower level out of the levels 0 through 5 was practically unproblematic. That is, it could be considered that (i) the white spot classified to the level 2 or the lower level was unproblematic, and (ii) a white spot classified to a level greater than the level 2 was problematic. A linear approximation for the detected amounts of nitrate ions and average values of white spot evaluation levels in Comparative Examples 1, 3, and 4 and Example 2 shown in FIG. 11 was determined. Based on the linear approximation, a detected amount of nitrate ions corresponding to a threshold between the levels 2 and 3 was found to be approximately 110 ng/L. In view, it could be considered that, (i) if a detected amount of nitrate ions detected by the above detecting method was 110 ng/L or smaller, a resultant white spot was unproblematic, and (ii) if a detected amount of nitrate ions detected by the above detecting method was greater than 110 ng/L, a resultant white spot was problematic.

(1-3-4. Experiment 4 (Experiment for Studying Relationship between Film Thickness of Aluminum Sheet and White Spot Reduction Effect)

The following description discusses results of experiment in which relationships between film thicknesses of the aluminum sheet 55 and white spot reduction effects were studied.

In the experiment, image forming operations were firstly carried out by using the following charging apparatuses 5 of Examples 4 through 7 and Comparative Example 5. Then, measurements were carried out to measure amounts of nitrate ions in these charging apparatuses 5 left after the image forming operations. The charging apparatuses 5 of Examples 4 through 7 were configured so that aluminum area ratios were set to 100% by attaching the aluminum sheet 55 to the entire second inner wall surface of the shield case 51 which second inner wall surface was in the downstream of the rotation direction of the photoreceptor drum 3.

Example 4

Metallic foil sheet manufactured by DIC Corporation (model number of 52050LA, a flexible aluminum film thickness was 50 μm, and an electrically conductive acrylic-based adhesive agent was used)

Example 5

Metallic foil adhesive tape manufactured by NITTO DENKO CORPORATION (product name of NITOFOIL AT-80, a flexible aluminum film thickness was 80 μm, and an electrically conductive acrylic-based adhesive agent was used)

Example 6

Metallic foil adhesive tape manufactured by NITTO DENKO CORPORATION (product name of NITOFOIL AT-30, a flexible aluminum film thickness was 30 μm, and an electrically conductive acrylic-based adhesive agent was used)

Example 7

Electrically conductive aluminum foil adhesive tape manufactured by TERAOKA SEISAKUSHO Co., Ltd (model number of 8303, a aluminum foil film thickness was 50 μm, and an electrically conductive acrylic-based adhesive agent was used)

Comparative Example 5

No aluminum tape (the shield case 51 was made from stainless)

In Experiment 1, the charging apparatuses 5 were tested after carrying out the image forming operations with respect to 100,000 pieces of A-4 size recording sheets under the room-temperature and low humid environment condition that a temperature was 25° C. and a humidity was 5%. In Experiment 4, in contrast, the charging apparatuses 5 of Examples 4 through 7 and Comparative Example 5 were tested after being installed to the respective image forming apparatuses 100 and carrying out the image forming operations with respect to 138,000 pieces of A-4 size recording sheets under a room-temperature and low humid environment conditions that a temperature was 25° C. and a humidity was 5%. Other than the above, the charging apparatuses 5 of Examples 4 through 7 and Comparative Example 5 were tested in same conditions as Example 1.

FIG. 12 is a graph showing each experiment result of Experiment 4. As shown in FIG. 12, it was possible to obtain sufficient nitrate ions reduction effects that could reduce white spots to practically unproblematic level, irrespective of the film thickness and type of the aluminum sheet 55.

(1-3-5. Experiments 5 (Experiment for Studying Relationship Between Area Ratio of Attached Aluminum Sheet and White Spot Reduction Effect))

The following description discusses results of an experiment for studying relationships between (i) area ratios of the aluminum sheet 55 attached to the shield case 51 and (ii) white spot reduction effects and image deletion reduction effects.

In the experiment, image forming processes were carried out by using different charging apparatuses 5 (i) through (vii), (i) the charging apparatus 5 from which the aluminum sheet 55 was removed (Comparative Example 1), (ii) the charging apparatus 5 in which the area ratio of the aluminum sheet 55 attached to the shield case 51 was 40% (Example 1), (iii) the charging apparatuses 5 in which the area ratio of the aluminum sheet 55 attached to the shield case 51 was 67% (Example 2), (iv) the charging apparatus 5 in which the area ratio of the aluminum sheet 55 attached to the shield case 51 was 85% (Example 8), (v) the charging apparatus 5 in which the area ratio of the aluminum sheet 55 attached to the shield case 51 was 88% (Example 9), (vi) the charging apparatus 5 in which the area ratio of the aluminum sheet 55 attached to the shield case 51 was 90% (Example 10), and (vii) the charging apparatus 5 in which an area ratio of the aluminum sheet 55 attached to the shield case 51 was 100% (Example 11).

As the aluminum sheet 55, a metallic foil sheet manufactured by DIC Corporation (product number of 52050LA, flexible aluminum film thickness of 50 μm, and an electrically conductive acrylic-based adhesive agent was used) was used. A length of the aluminum sheet 55 was 322 mm so as to be identical with a longitudinal length of the shield case 51 (longitudinal direction was the direction in which the shield case 51 was extended). The aluminum sheet 55 was attached to the second inner wall surface of the shield case 55 which second inner wall surface was in the downstream of the rotation direction of the photoreceptor drum 3, in such a manner that a longitudinal side of the aluminum sheet 55 was aligned to a photoreceptor-drum 3-side of the second inner wall surface of the shield case 51 (the longitudinal direction was the direction in which the shield case 51 was extended).

The charging apparatuses 5 of the examples and the comparative examples were installed in respective image forming apparatuses 100. The image forming apparatuses 100 having the configurations carried out image forming operations, for one month, with respect to 3,000 pieces of recording sheets in an environment condition that a temperature was 25° C. and a humidity was 5%. After this, the image forming apparatuses 100 carried out image forming operations with respect to another 50 pieces of recording sheets, and then left for one hour. Subsequently, the image forming apparatuses 100 carried out image forming operations with respect to another sets of recording sheets. Resultant images formed on the another sets of recording sheets were visually inspected. In the visual inspection, an inspector checked generation conditions of white-spot image failures that were caused in halftone images of each circumference pitch of the photoreceptor drum 3. Evaluation criteria were set so that (i) ◎ (double circle) was marked in a case where no white-spot image failure was caused, (ii) ○ was marked in a case where a striped white-spot image failure of a width of 10 mm or smaller was caused, (iii) Δ was marked in a case where a striped white-spot image failure of a width of 10 mm or greater but 20 mm or smaller was caused, and (iv) x was marked in a case where a striped white-spot image failure of a width greater than 20 mm was caused.

Also, the charging apparatuses of the examples and the comparative examples were installed in respective image forming apparatuses 100. Then, these image forming apparatuses 100 carried out image forming operations, for one month, with respect to 3,000 pieces of recording sheets in an environmental condition that a temperature was 35° C. and a humidity was 85%. After this, the image forming apparatuses 100 carried out image forming operations with respect to another 50 pieces of recording sheets, and left for one hour. Then, the image forming apparatuses 100 carried out image forming operations with respect to another sets of recording sheets so as to form text images on them. Then, the resultant text images formed on the another sets of recording sheets were visually inspected. In the visual inspection, an inspector checked generation conditions of text blurring in the text images so as to evaluate image-deletion image failures. Criteria for the evaluation were set so that (i) ◎ (double circle) was marked in a case where no text blurring was caused, (ii) ○ was marked in a case where text blurring was slightly caused, (iii) Δ was marked in a case where text blurring was noticeably caused, but a text was fully recognizable, and (iv) x was marked in a case where text blurring was caused so severely that no text was recognizable.

FIG. 14 is a table in which experiment results are shown. As is obvious from FIG. 14, in a case of setting the area ratio of the aluminum sheet 55 attached to the shield case 51 (the ratio of the area of the aluminum sheet 55 attached to the area of that inner wall surface of the shield case 51 which faced the discharging electrode 53 (the second inner wall surface of the shield case 51) to 88% or greater but 100% or smaller, it was possible to prevent generation of an image failures such as a white spot, a text blurring (image deletion), or the like by absorbing and removing corona products by an oxidized layer formed by oxidization of the aluminum sheet 55.

As described so far, the charging apparatus 5 of the present embodiment is configured so that the aluminum sheet 55 is attached to the inner wall surface of the shield case 51. According to the configuration, the aluminum sheet 55 absorbs nitrate ions generated by the corona discharge in the image forming operation, so as to decrease the amount of nitrate ions that migrates to the photoreceptor drum 3. Therefore, it is possible to prevent a white spot from being caused by adhesion of nitrate ions to the photoreceptor drum 3.

For obtainment of the white spot reduction effect, it is simply required to attach the aluminum sheet 55 to the shield case 51. Therefore, it is possible to obtain the white spot reduction effect at cost lower than cost required for obtaining the white spot reduction effect in a case of employing a shield case made from aluminum or applying aluminum hydroxide to the inner wall surface of the shield case.

In the present embodiment, the aluminum sheet 55 is oxidized so as to form aluminum oxide having a plurality of holes. Resultant aluminum oxide having the plurality of holes absorbs nitrate ions so as to decrease an amount of nitrate ions that migrates to the photoreceptor drum 3 from the charging apparatus 5. According to this arrangement, there was no consumption of aluminum hydroxide, unlike an arrangement as taught in Patent Literature 1 in which nitrogen oxide is irreversibly neutralized by chemical reacting aluminum hydroxide and nitrate ions. With the arrangement, it is therefore possible to stably obtain nitrate ions absorption effect for an extended period of time.

Further, in a case where the nitrate ions absorption effect by the aluminum sheet 55 is deteriorated, it can be restored by simply changing the aluminum sheet 55. This can make maintenance of the charging apparatus 5 easier.

A white spot can be prevented even in a case where the fans are stopped from forcibly discharging the air after the image forming operation. It is therefore possible to reduce electric power consumption by fan driving and thereby reduce a running cost. The charging apparatus 5 of the present embodiment may include a fan for discharging air from the inside of the shield case 51 and a control section for controlling fan driving (neither the fan nor the control section is shown in the drawings). The control section may stop a rotation of the fan after the image forming operation.

The greater the area of the aluminum sheet 55 attached to the shield case 51 is, the greater the nitrate ions absorption effect of the aluminum sheet 55 is. However, as is obvious from the above-described, experiment results, it is possible to obtain the substantially similar nitrate ions absorption effects in the following two cases (i) and (ii), the case (i) in which the aluminum sheet 55 is attached only to the second inner wall surface of the shield case 51 which second inner wall surface is in the downstream of the rotation direction of the photoreceptor drum 3, and the case (ii) in which the aluminum sheet 55 is attached to each of the first and second inner wall surfaces of the shield case 51, the first inner wall surfaces is in the upstream of the rotation direction of the photoreceptor drum 3 and the second inner wall surface is in the downstream of the rotation direction of the photoreceptor drum 3. In view of this, in order to obtain a sufficient white spot prevention effect and achieve a reduction in cost, it is preferable to employ the configuration in which the aluminum sheet 55 is attached only to the second inner wall surface of the shield case 51.

Further, for proper prevention of a white spot irrespective of operation conditions of the image forming apparatus, it is preferable that a ratio of the area of the aluminum sheet 55 attached to the area of the second inner wall surface of the shield case 3 falls within a range of 88% or greater and 100% or smaller.

The present embodiment discusses a case in which the present invention is applied to a scorotron discharging apparatus including the grid electrode 54. However, the present embodiment is not limited to this. The present invention may be applied to a corotron charging apparatus including no grid electrode.

The present invention is not limited to the description of the embodiments above, but may be altered by a skilled person within the scope of the claims. That is, an embodiment based on a combination of technical means properly modified within the scope of the claims is encompassed in the technical scope of the present invention.

INDUSTRIAL APPLICABILITY

The present invention can be applied to a corona charging apparatus and an image forming apparatus including the same.

REFERENCE SIGNS LIST

3 photoreceptor drum (image bearing member)
5 charging apparatus
51 shield case

51*a* chipped section
52 discharging electrode holding member (supporting member)
52*a* protrusion section
53 discharging electrode
53*a* pointed protrusion section
54 grid electrode
55 aluminum sheet (sheet-like member)
100 image forming apparatus
P image forming section

The invention claimed is:

1. A corona charging apparatus for electrically charging a surface of an image bearing member to which the corona charging apparatus faces and which is rotatably provided in an electrophotographic image forming apparatus, the corona charging apparatus comprising:

a discharging electrode;

a shield case formed of an electrically conductive material that covers the discharging electrode, the shield case being opened at least in a region where the discharging electrode and the image bearing member face each other; and a sheet-like member being made from aluminum and being attached only to a first surface of the shield case, which first surface faces the discharging electrode, and wherein the first surface is downstream of the discharging electrode in a rotation direction of the image bearing member.

2. The corona charging apparatus as set forth in claim 1, wherein:

the shield case has a quadrangular shape having four sides with respect to a direction in which the shield case is extended, the four sides including one open surface and three closed surfaces, and the shield case is provided so as to be extended in parallel with the rotation axis direction of the image bearing member and so that the open surface faces the image bearing member; and the first surface is that of the three closed surfaces which is provided downstream of the discharging electrode in the rotation direction of the image bearing member, the sheet-like member being attached along the direction in which the shield case is extended, so as to cover a region of the first surface, the region being extended in a predetermined range from an open-surface side of the first surface.

3. The corona charging apparatus as set forth in claim 2, wherein a ratio of an area of the sheet-like member to an area of the first surface of the shield case is not less than 88% but not more than 100%.

4. The corona charging apparatus as set forth in claim 1, wherein the sheet-like member has a film thickness of not less than 30 μm but not more than 80 μm.

5. The corona charging apparatus as set forth in claim 1, wherein the sheet-like member is detachably attached to the shield case.

6. An image forming apparatus comprising a charging apparatus as set forth in claim 1.

* * * * *